US011674432B2

(12) United States Patent
Somsedik

(10) Patent No.: US 11,674,432 B2
(45) Date of Patent: Jun. 13, 2023

(54) IDENTIFICATION AND REDUCTION OF BACKFLOW SUCTION IN COOLING SYSTEMS

(71) Applicant: CLARK EQUIPMENT COMPANY, Statesville, NC (US)

(72) Inventor: Jan Somsedik, Dobris (CZ)

(73) Assignee: Clark Equipment Company, Statesville, NC (US)

( * ) Notice: Subject to any disclaimer, the term of this patent is extended or adjusted under 35 U.S.C. 154(b) by 0 days.

(21) Appl. No.: 17/238,776

(22) Filed: Apr. 23, 2021

(65) Prior Publication Data

US 2021/0332737 A1 Oct. 28, 2021

Related U.S. Application Data

(60) Provisional application No. 63/014,461, filed on Apr. 23, 2020.

(51) Int. Cl.
*F01P 5/06* (2006.01)

(52) U.S. Cl.
CPC ..... *F01P 5/06* (2013.01); *F01P 2070/50* (2013.01)

(58) Field of Classification Search
CPC ..... F04D 29/667; F04D 29/325; B60K 11/06; F01P 5/06; F01P 11/10
See application file for complete search history.

(56) References Cited

U.S. PATENT DOCUMENTS 2,084,462 A 6/1937 Stalker
2,294,586 A 9/1942 Troller
2003/0007867 A1 1/2003 Chang
2006/0147304 A1* 7/2006 Cho ..... F04D 29/544 415/191
2011/0303395 A1* 12/2011 Mori ..... B60K 11/04 165/104.34

(Continued)

FOREIGN PATENT DOCUMENTS

JP 63147600 U 9/1988

OTHER PUBLICATIONS

International Search Report and Written Opinion dated Jul. 6, 2021 for corresponding International Application No. PCT/US2021/028882 (17 pages).

*Primary Examiner* — Long T Tran
(74) *Attorney, Agent, or Firm* — Michael Best & Freidrich LLP

(57) ABSTRACT

A cooling assembly configured to reduce backflow suction in a mobile platform including a prime mover, at least one heat exchanger fluidly connected to the prime mover, a blower upstream of the at least one heat exchanger configured to generate a current of cooling air to cool the at least one heat exchanger, and a backflow suction reduction member positioned downstream of the blower and upstream of the at least one heat exchanger, the backflow suction reduction member defining an internal channel including a first opening at one end, a second opening at a second end, and at least one third opening positioned between the first and second ends. The backflow suction reduction member is configured to receive airflow through the first and second openings and discharge the airflow through the at least one third opening in a region where air is backflowing from the at least one heat exchanger.

20 Claims, 8 Drawing Sheets

(56) References Cited

U.S. PATENT DOCUMENTS

| | | | | |
|---|---|---|---|---|
| 2012/0321474 | A1* | 12/2012 | Stevens | F04D 29/545<br>416/190 |
| 2015/0125287 | A1 | 5/2015 | Briand | |
| 2015/0204351 | A1* | 7/2015 | Watanabe | F01P 5/02<br>415/213.1 |
| 2016/0333893 | A1* | 11/2016 | Kondou | F04D 19/002 |
| 2016/0341220 | A1* | 11/2016 | Kondou | F04D 19/002 |
| 2017/0021719 | A1* | 1/2017 | Jyouzaki | B62J 17/10 |
| 2017/0334283 | A1* | 11/2017 | Haussmann | F01P 3/18 |
| 2018/0274500 | A1* | 9/2018 | Underhill | B01D 46/70 |
| 2019/0226747 | A1* | 7/2019 | Haddad | F04D 29/326 |
| 2020/0072236 | A1* | 3/2020 | Jensen | F24F 7/065 |

* cited by examiner

IDENTIFICATION AND REDUCTION OF BACKFLOW SUCTION IN COOLING SYSTEMS

CROSS-REFERENCE TO RELATED APPLICATIONS

This application claims the benefit of U.S. Provisional Application No. 63/014,461, which was filed on Apr. 23, 2020 and titled "Identification and Reduction of Backflow Suction in Cooling Systems, the contents of which is hereby incorporated by reference in its entirety.

FIELD

This disclosure is directed toward power machines. More particularly, this disclosure is directed to a cooling system for power machines that reduces backflow suction and redistributes static pressure to improve cooling system performance.

BACKGROUND

Power machines, for the purposes of this disclosure, include any type of machine that generates power to accomplish a particular task or a variety of tasks. One type of power machine is an air compressor. Air compressors are generally self-contained power generating devices that include a prime mover that provides a power output and a compressor that receives the power output from the prime mover and converts the power output into pressurized air. The pressurized air can, in turn, be provided to a pneumatically powered device that acts as a load on the compressor. Air compressors can be stationary (i.e., not designed to be moved once installed in a work location) or portable. Some portable compressors include a trailer that can be pulled by a vehicle from one work location to another. Other portable compressors are small enough that they can be carried to a work location.

The discussion above is merely provided for general background information and is not intended to be used as an aid in determining the scope of the claimed subject matter.

SUMMARY

The disclosure herein is directed to a power machine that includes an improved cooling assembly that reduces undesirable backflow suction, which can adversely affect performance of the cooling assembly. The improved cooling assembly includes a backflow suction reduction assembly that is configured to redistribute cooling air from a zone having a higher static pressure to a zone having a lower static pressure. The zone having a lower static pressure is indicative of less air going through the at least one heat exchanger (coolers). When static pressure is significantly low or negative, it is indicative of an area adversely affected by backflow suction. By redistributing cooling air from zones of high static pressure to zones of lower static pressure, overall performance of the cooling assembly is improved by making the temperature of the cooling air more uniform (or equalized) throughout the zones.

In one embodiment, a cooling assembly is configured to reduce backflow suction in a mobile platform including a prime mover, at least one heat exchanger fluidly connected to the prime mover, a blower upstream of the at least one heat exchanger, the blower configured to generate a current of cooling air to cool the at least one heat exchanger, and a backflow suction reduction member positioned downstream of the blower and upstream of the at least one heat exchanger, the backflow suction reduction member defining an internal channel that includes a first opening at one end, a second opening at a second end, and at least one third opening positioned between the first and second ends. The backflow suction reduction member is configured to receive an airflow through the first and second openings and discharge the airflow through the at least one third opening in a region where air is backflowing from the at least one heat exchanger.

In another embodiment a cooling assembly includes at least one heat exchanger, a first region upstream of the at least one heat exchanger, a second region downstream of the at least one heat exchanger, a blower configured to generate a current of cooling air flowing through the first region to cool the at least one heat exchanger, the cooling air configured to increase in temperature in response to interacting with the at least one heat exchanger transitioning to heated air, the heated air configured to discharge through the second region, and a backflow suction reduction assembly positioned in the first region and defining a first inlet at one end, a second inlet at a second end, a first outlet positioned between the first and second ends, and a second outlet positioned between the first and second ends, the first inlet in fluid communication with the first outlet, and the second inlet in fluid communication with the second outlet. The backflow suction reduction assembly is configured to direct air from a first zone of the first region to a second zone of the first region, the first inlet positioned in the first zone and the first outlet positioned in the second zone. The backflow suction reduction assembly is configured to direct air from a third zone of the first region to the second zone of the first region, the second inlet positioned in the third zone and the second outlet positioned in the second zone.

This Summary and the Abstract are provided to introduce a selection of concepts in a simplified form that are further described below in the Detailed Description. This Summary is not intended to identify key features or essential features of the claimed subject matter, nor are they intended to be used as an aid in determining the scope of the claimed subject matter.

DRAWINGS

DETAILED DESCRIPTION

The concepts disclosed in this discussion are described and illustrated by referring to exemplary embodiments. These concepts, however, are not limited in their application to the details of construction and the arrangement of components in the illustrative embodiments and are capable of being practiced or being carried out in various other ways. The terminology in this document is used for the purpose of description and should not be regarded as limiting. Words such as "including," "comprising," and "having" and variations thereof as used herein are meant to encompass the items listed thereafter, equivalents thereof, as well as additional items.

For purposes of clarity, in this Detailed Description, use of the term "fluid" shall refer to any gas or liquid unless otherwise explicitly specified. The term "parameter" shall mean any condition, level or setting for a power machine including air compressors. Examples of air compressor operating parameters include discharge pressure, discharge fluid temperature, and prime mover speed. Additionally, the terms "lubricant" and "coolant" as used herein shall mean the fluid that is supplied to a compression module and mixed with the compressible fluid during compressor operation. One preferred lubricant includes oil.

A power machine 300 includes a cooling assembly 328 having a backflow suction reduction assembly 400. The backflow suction reduction assembly 400 redistributes cooling air from a zone having a higher static pressure to a zone having a lower static pressure, which is indicative of an area adversely affected by backflow suction. By redistributing cooling air to zones having a lower static pressure, overall performance of the cooling assembly 328 is improved by making the temperature of the cooling air more uniform (or equalized).

These concepts can be practiced on various power machines, as will be described below. A representative power machine on which the embodiments can be practiced is illustrated in diagram form in FIG. 1. Power machines, for the purposes of this discussion, include a frame and a power source that can provide power to a work element to accomplish a work task. One type of power machine is an air compressor. Air compressors typically include a power source that creates a compressed air output that is suitable for providing compressed air to various loads that, in turn, can perform various work tasks. Another type of power machine is a generator. Generators typically include a power source that generates an electrical output that is suitable for electrically powering various loads that, in turn, can operate in response to the electrical output.

Figure 1:
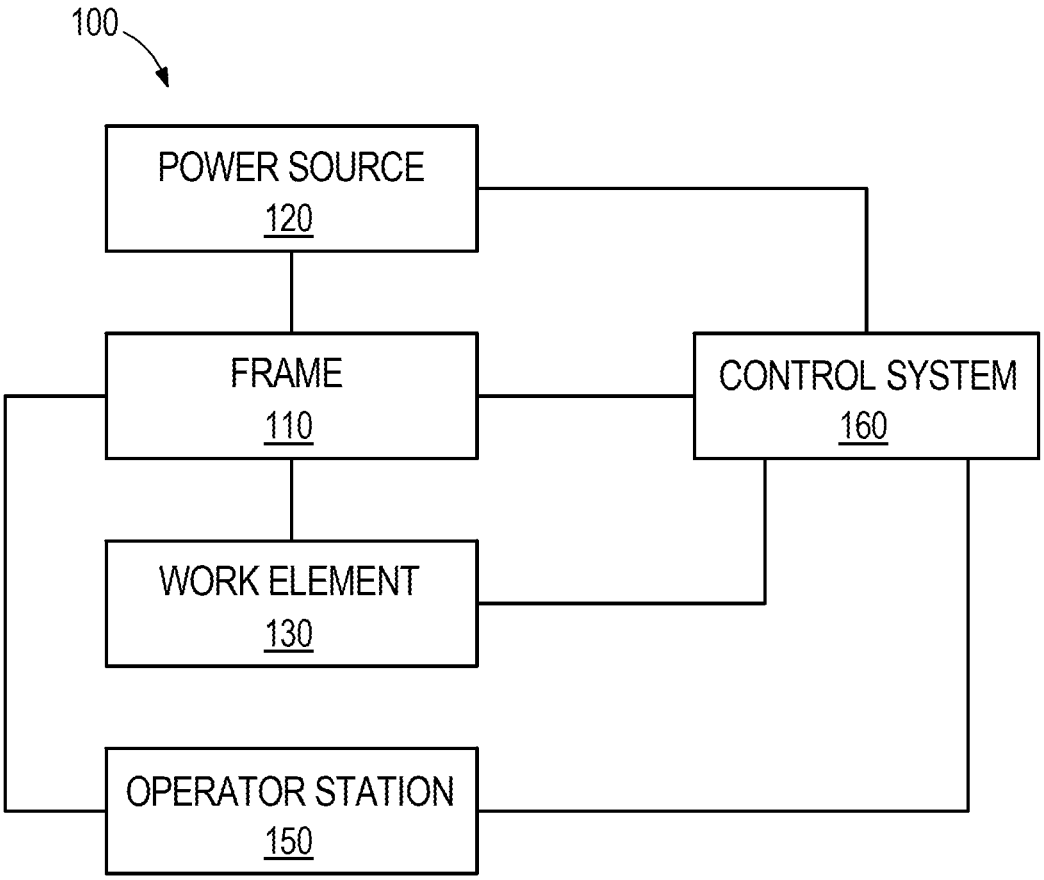
FIG. 1 is a block diagram illustrating functional systems of a representative power machine on which embodiments of the present disclosure can be advantageously practiced.

FIG. 1 is a block diagram that illustrates the basic systems of a power machine 100, which can be any of a number of different types of power machines, upon which the embodiments discussed below can be advantageously incorporated. The block diagram of FIG. 1 identifies various systems on power machine 100 and the relationship between various components and systems. As mentioned above, at the most basic level, power machines for the purposes of this discussion include a frame and a power source that can be coupled to a work element. The power machine 100 has a frame 110, a power source 120, and an interface to a work element 130.

Some representative power machines may have one or more work elements resident on the frame 110, including, in some instances a traction system for moving the power machine under its own power. However, it is not necessary or even uncommon for a representative power machine on which the inventive elements discussed below may be advantageously practiced to not have a traction system or indeed any onboard work element. For the purposes of this discussion, any load on the compressor should be considered a work element, even if it doesn't perform work in the classic sense of providing energy to move an object over a distance. Power machine 100 has an operator station 150 that provides access to one or more operator controlled inputs for controlling various functions on the power machine. These operator inputs are in communication with a control system 160 including a controller that is provided to interact with the other systems to perform various tasks related to the operation of the power machine at least in part in response to control signals provided by an operator through the one or more operator inputs. The operator station 150 can also include one or more outputs for providing a power source that is couplable to an external load. Frame 110 includes a physical structure that can support various other components that are attached thereto or positioned thereon. The frame 110 can include any number of individual components.

Frame 110 supports the power source 120, which is configured to provide power to one or more work elements 130 that may be coupled to or integrated with the power machine 100. Power sources for power machines typically include an engine such as an internal combustion engine and a power conversion system such as a compressor that is configured to convert the output from an engine into a form of power (i.e., compressed air) that is usable by a work element.

FIG. 1 shows a single work element designated as work element 130, but various power machines can have any number of work elements. Work elements are operably coupled to the power source of the power machine to perform a work task. Work elements can be removably coupled to the power machine to perform any number of work tasks. For the purposes of this example, work element 130 can be an integrated work element or a work element that is not integrated into the power machine, but merely couplable to the power machine.

Operator station 150 includes an operating position from which an operator can control operation of the power machine by accessing user inputs. Such user inputs can be manipulated by an operator to control the power machine by, for example, starting an engine, setting an air pressure level or configuration, and the like. In addition, the operator station 150 can include outputs such as ports to which external loads can be attached. In some power machines, the user inputs and outputs can be located in the same general area, but that need not be the case. An operator station 150 can include an input/output panel that is in communication with the controller of control system 160.

Figure 2:
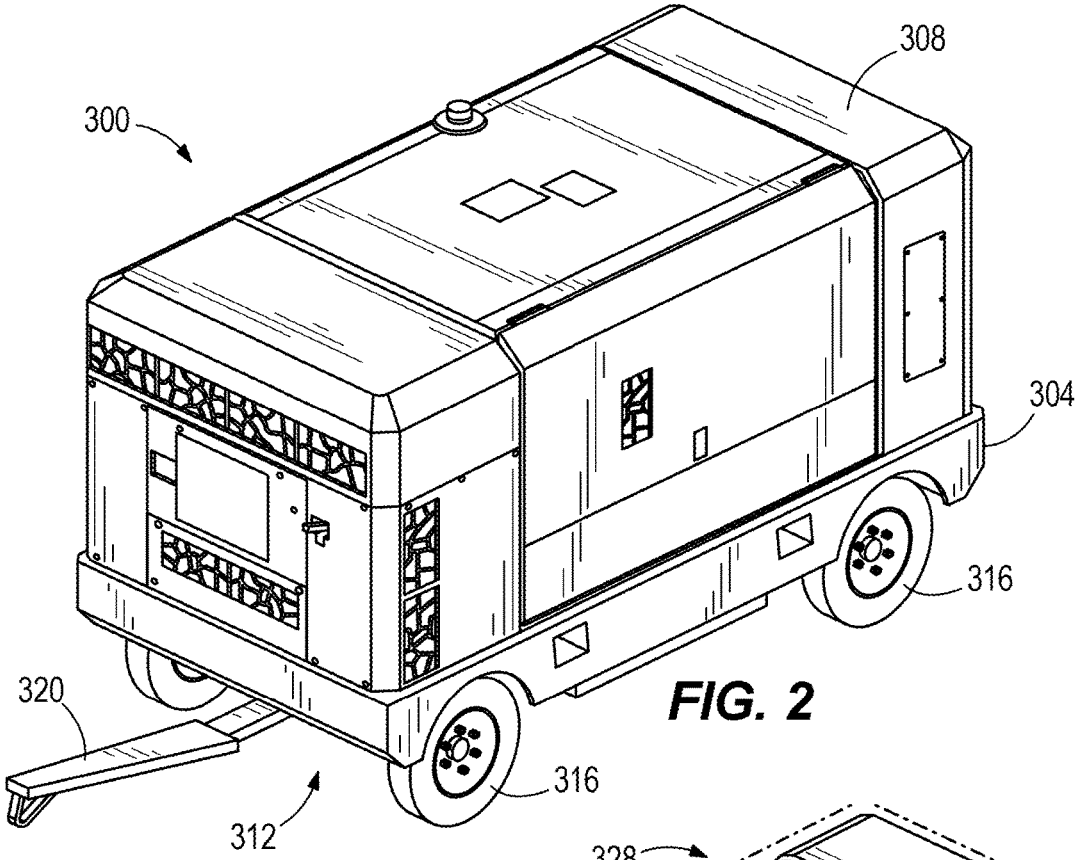
FIG. 2 is a perspective view of an embodiment of a power machine.

FIG. 2 illustrates a perspective view of an embodiment of a power machine 300. The power machine 300 is illustrated as an air compressor system. However, in other embodiments, the power machine 300 can be a generator (also referred to as an electrical generator). The power machine 300 includes a housing 304 that provides a frame structure to which components can be mounted. An enclosure 308 can removably engage the housing 304 to protect one or more of the components mounted to the housing 304. The housing 304 can also include a transport assembly 312 to facilitate movement, transport, and/or repositioning of the power machine 300. The transport assembly 312 can include a plurality of wheels 316 and a trailer hitch 320. The plurality of wheels 316 includes two pairs of wheels. However, in other embodiments, any suitable number of wheels 316 can be included in the plurality of wheels 316 (e.g., 2, 3, 4, or 5 or more). The transport assembly 312 defines a mobile platform. Accordingly, the power machine 300 can be referred to as being provided in a mobile platform.

Figure 3:
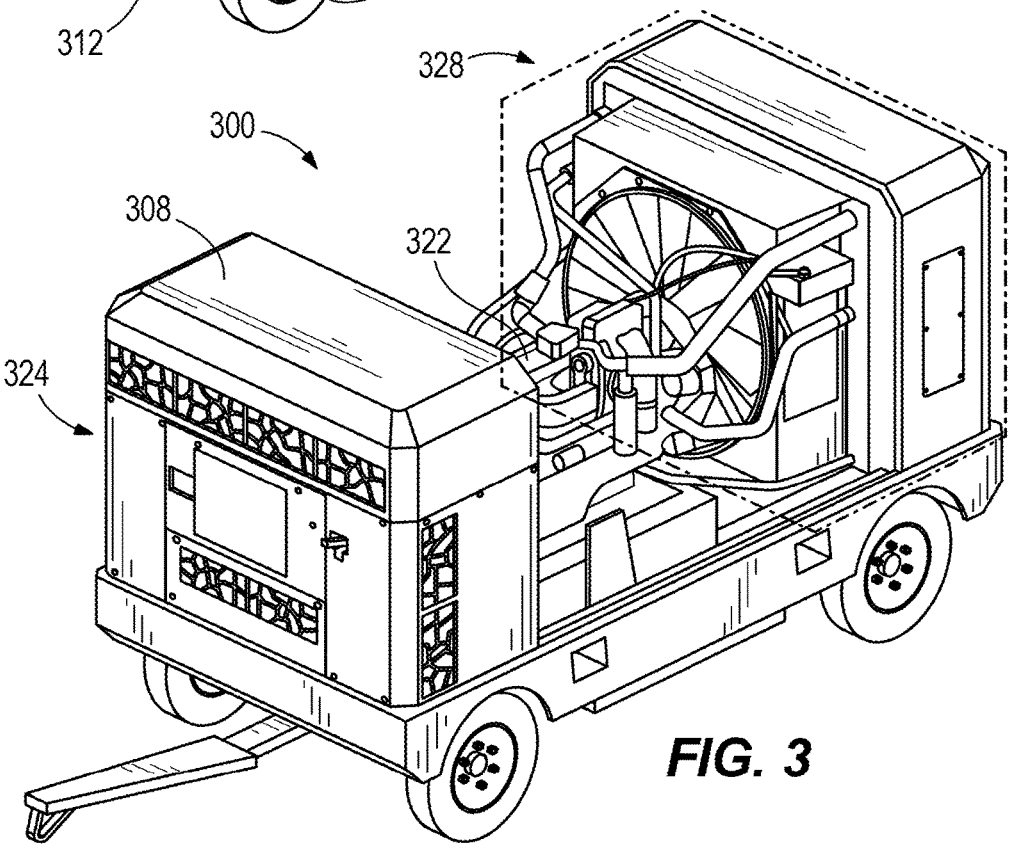
FIG. 3 is a perspective view of the power machine of FIG. 2 with a portion of an enclosure removed to illustrate a prime mover and a cooling assembly.

FIG. 3 illustrates the power machine 300 of FIG. 2 with a portion of the enclosure 308 removed. The power machine 300 includes a prime mover 322. The prime mover 322 is operably connected to a power conversion system 324 (e.g., an air compressor, a generator, etc.). The power conversion system 324 is configured to convert power from the prime mover 322 into a form that can be used by work elements (e.g., an air compressor converts power from the prime mover 322 into compressed air for use by work elements, a generator converts power from the prime mover 322 into electricity for use by work elements, etc.). A cooling assembly 328 (or a cooling system 328) is positioned downstream of the prime mover 322.

Figure 4:
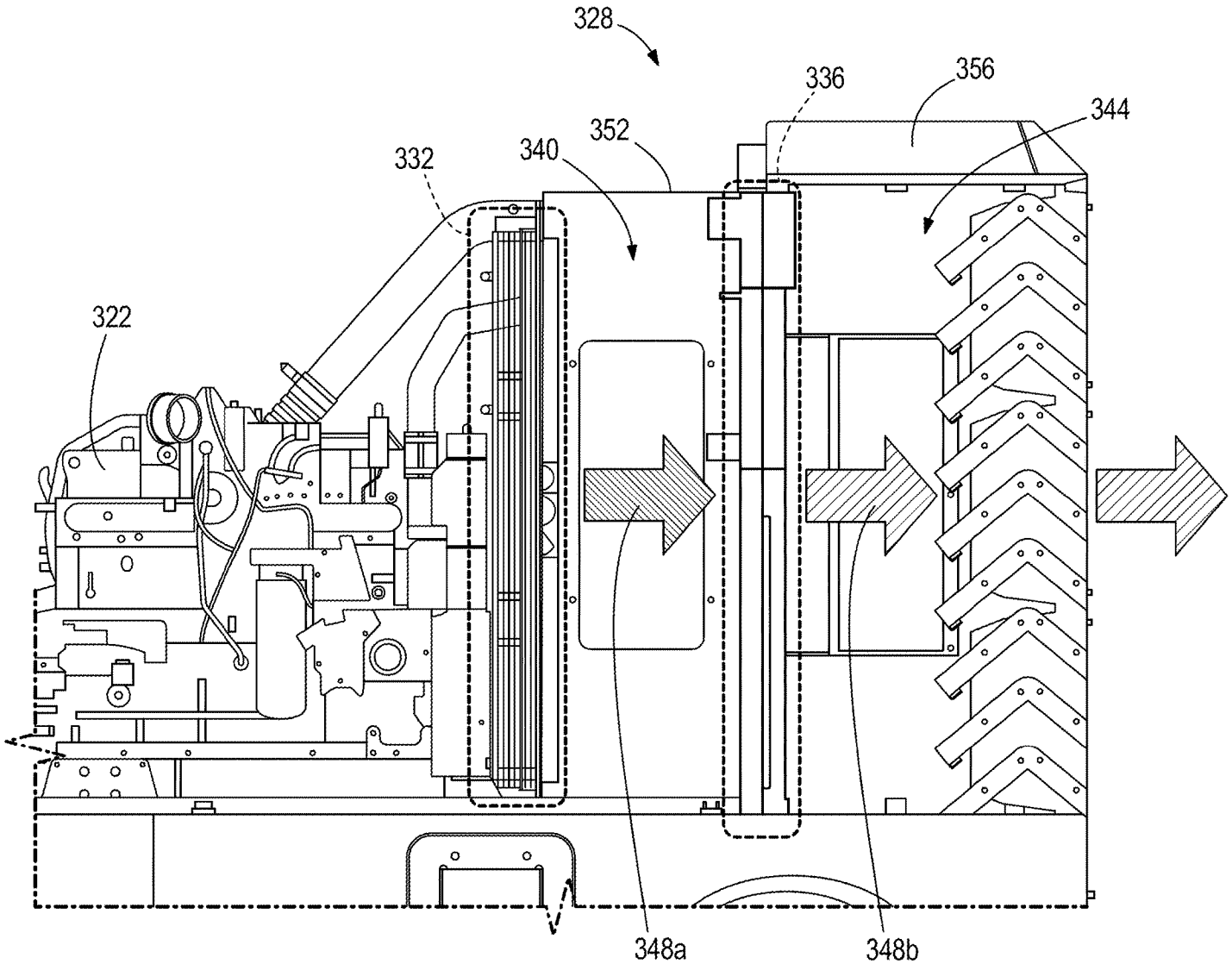
FIG. 4 is a side view of the prime mover and a cross-sectional side view of the cooling assembly of FIG. 3.

With reference to FIG. 4, the cooling assembly 328 includes a fan 332 (or a blower fan 332) and at least one heat exchanger 336. The fan 332 is positioned upstream of the at least one heat exchanger 336 and is configured to push air through the at least one heat exchanger 336. Stated another way, the fan 332 is configured to generate a current of air (or cooling air) to cool (or reduce the temperature of) the at least one heat exchanger 336. The fan 332 is spaced from the at least one heat exchanger 336 by a first region 340. A second region 344 is positioned downstream of the at least one heat exchanger 336. The first region 340 includes air that is generally a first temperature, while the second region 344 includes air that is generally a second temperature that is greater than the first temperature. Accordingly, the first region 340 can be referred to as a cold-side relative to the at least one heat exchanger 336, and the second region 344 can be referred to as a hot-side relative to the at least one heat exchanger 336. In operation, air 348*a* generated by the fan 332 travels (or flows) through the first region 340 (or cold-side) at the first temperature. The air then interacts with the at least one heat exchanger 336, where the air cools the at least one heat exchanger 336 by absorbing heat. Accordingly, the air increases in temperature. The hotter air 348*b* then travels from the at least one heat exchanger 336 through the second region 344 (or hot-side) at the second temperature, the second temperature being greater than the first temperature. The hotter air 348*b* is then discharged from the cooling assembly 328. It should be appreciated that the first region 340 is defined by a housing 352, while the second region 344 is defined by a canopy 356.

Figure 5:
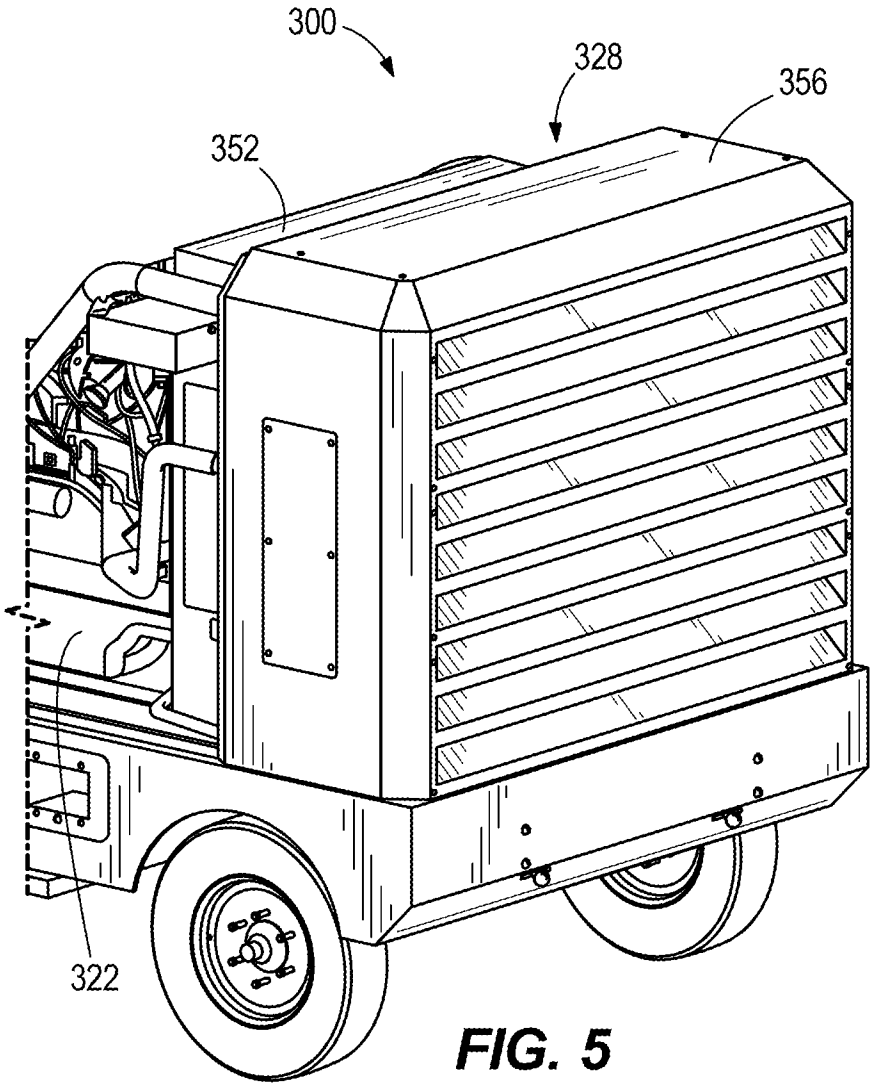
FIG. 5 is a perspective view of a rear portion of the power machine of FIG. 3.

FIG. 5 illustrates a perspective view of a rear portion of the power machine 300 of FIG. 3. The prime mover 322 and the cooling assembly 328 are illustrated. In addition, the housing 352 and the canopy 356 are illustrated relative to the prime mover 322.

Figure 6:
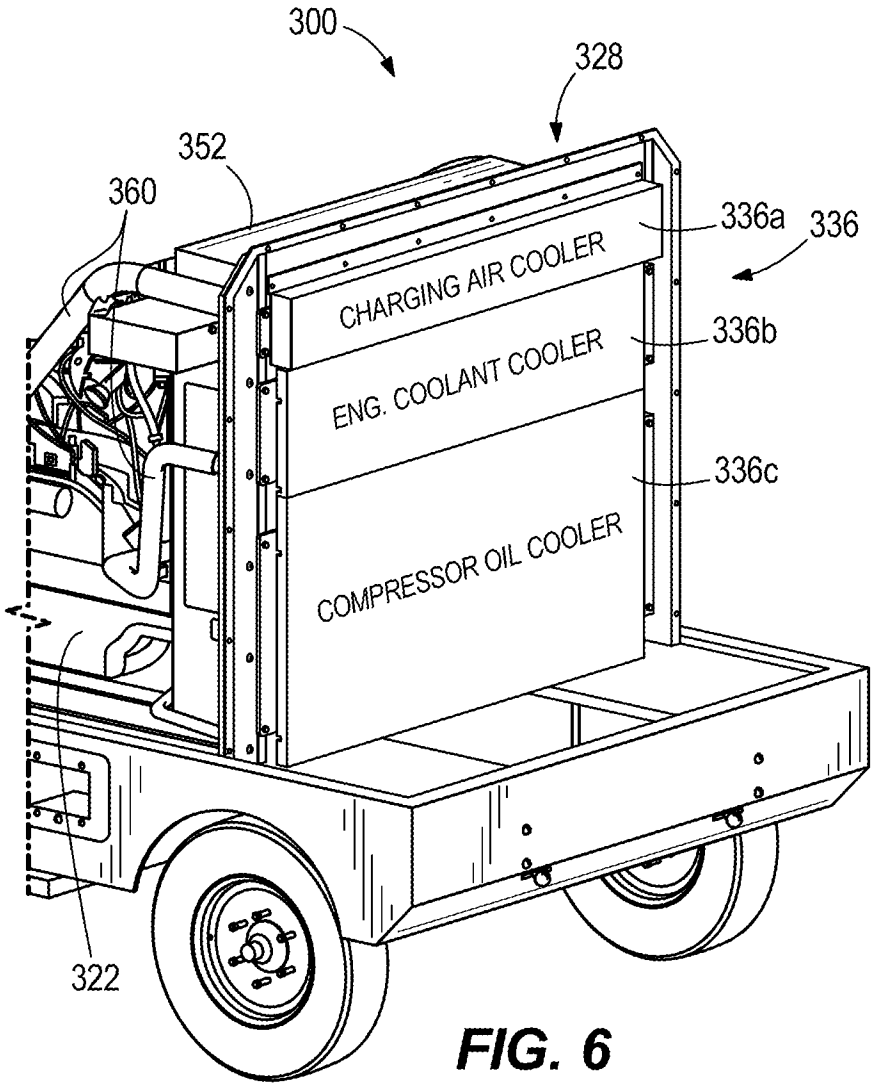
FIG. 6 is a perspective view of the rear portion of the power machine of FIG. 5, with the canopy removed to illustrate the at least one heat exchanger.

FIG. 6 illustrates the perspective view of the rear portion of the power machine 300 with the canopy 356 removed to further illustrate the at least one heat exchanger 336. The at least one heat exchanger 336 can include a plurality of heat exchangers 336. More specifically, the at least one heat exchanger 336 can include a first heat exchanger 336*a*, a second heat exchanger 336*b*, and a third heat exchanger 336*c*. The first heat exchanger 336*a* can be a charging air heat exchanger (or a charging air cooler). The second heat exchanger 336*b* can be an engine coolant heat exchanger (or an engine coolant cooler). The third heat exchanger 336*c* can be a compressor oil heat exchanger (or a compressor oil cooler). In other examples of embodiments, the at least one heat exchanger 336 can include a single heat exchanger, or two or more heat exchangers. In other embodiments, the at least one heat exchanger 336 can be any suitable number or type of heat exchanger needed to cool an associated fluid associated with operation of the prime mover 322. Each of the at least one heat exchangers 336 is fluidly connected to the prime mover 322 by associated conduits 360. The conduits 360 are configured to transport a fluid from the prime mover 322 to the at least one heat exchanger 336 for cooling (i.e., a supply conduit) and return the cooled fluid from the at least one heat exchanger 336 to the prime mover 322 (i.e., a return conduit). Separate supply and return conduits can be associated with each of the at least one heat exchangers 336.

Figure 7:
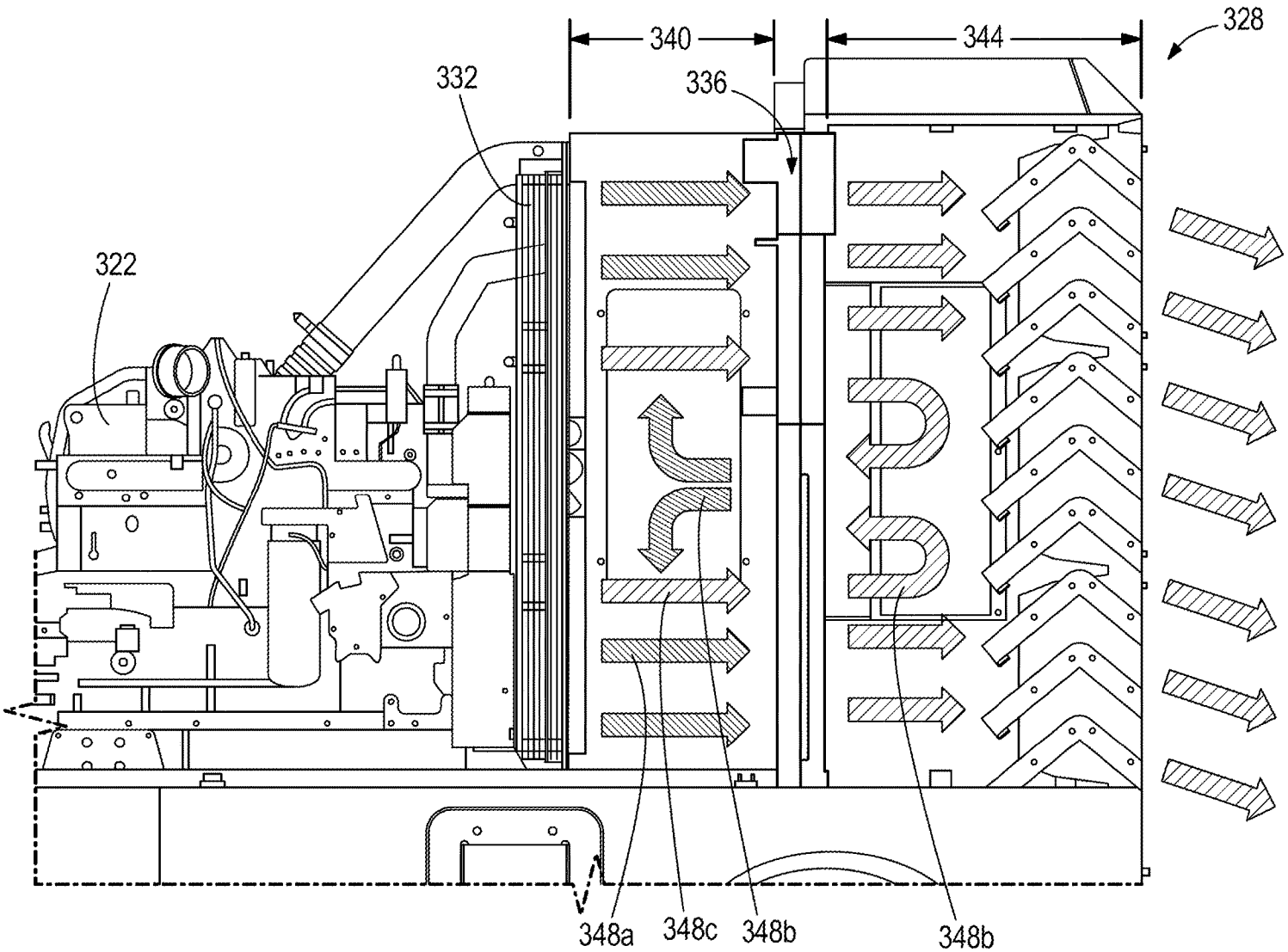
FIG. 7 is a side view of the prime mover and a cross-sectional side view of the cooling assembly illustrating undesirable backflow suction of hot air from the second region into the first region.

With reference now to FIG. 7, in certain embodiments of a cooling assembly 328 an undesirable phenomenon known as backflow suction can occur. Backflow suction is where a portion of the hotter air 348*b* (or heated air 348*b*) in the second region 344 (or hot-side) returns to the first region 340 (or cold-side) through the at least one heat exchanger 336. The area of the at least one heat exchanger 336 where the hotter air 348*b* is returning from the second region 344 to the first region 340 has a significant reduction in cooling performance (due to the return stream of hotter air). In addition, the hotter air 348*b* that returns from the second regions 344 to the first region 340 undesirably heats up (or increases the temperature) of the cooling air 348*a* in the first region 340. This results in the cooling air 348*a* being warmed to warmer air 348*c* in the first region 340, the warmer air 348*c* having a temperature that is greater than the cooling air 348*a*, but less than the hotter air 348*b*. The warmer cooling air 348*c* causes an overall reduction in performance of the cooling assembly 328, as the warmer cooling air 348*c* cannot absorb as much heat as the cooler cooling air 348*a*.

FIGS. 8-11 illustrate one or more examples of embodiments of a solution to reduce undesirable backflow suction in the cooling assembly 328. With specific reference to FIG. 8, a backflow suction reduction assembly 400 (also referred to as a backflow suction reduction member 400) is positioned in the first region 340 defined by the housing 352. The backflow suction reduction assembly 400 is positioned downstream of the fan 332 and upstream of the at least one heat exchanger 336 (shown in FIG. 7).

Figure 9:
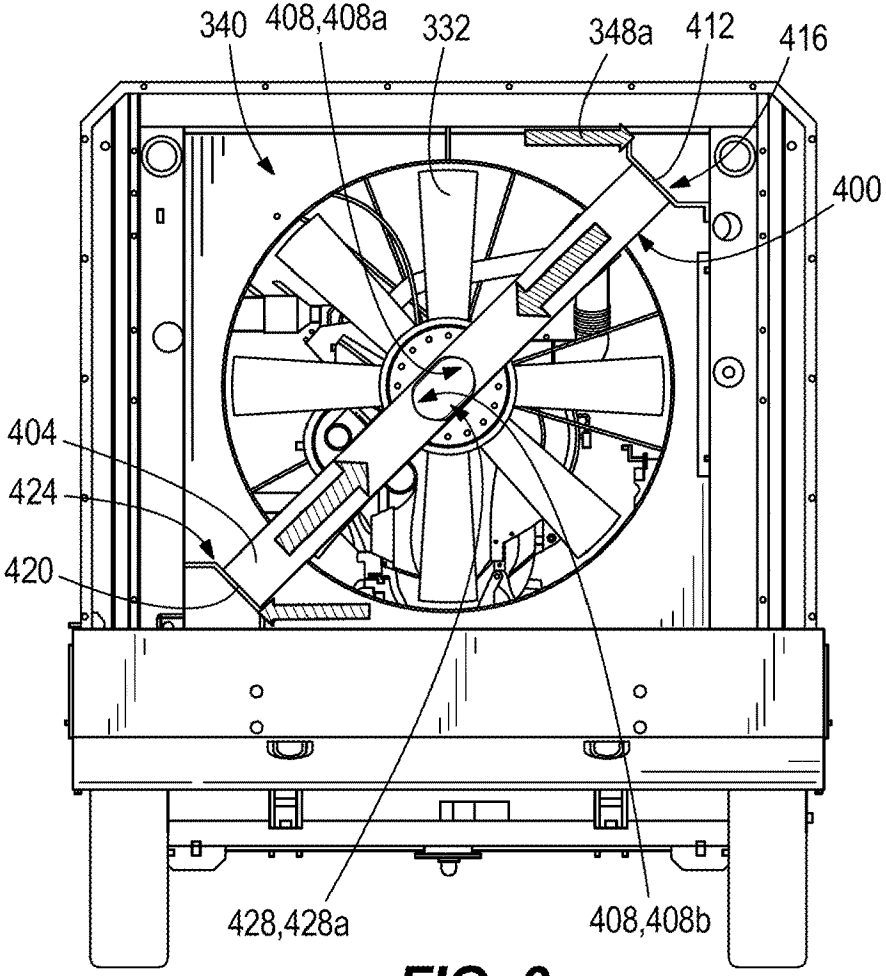
FIG. 9 is a rear view of the power machine of FIG. 8.
Figure 8:
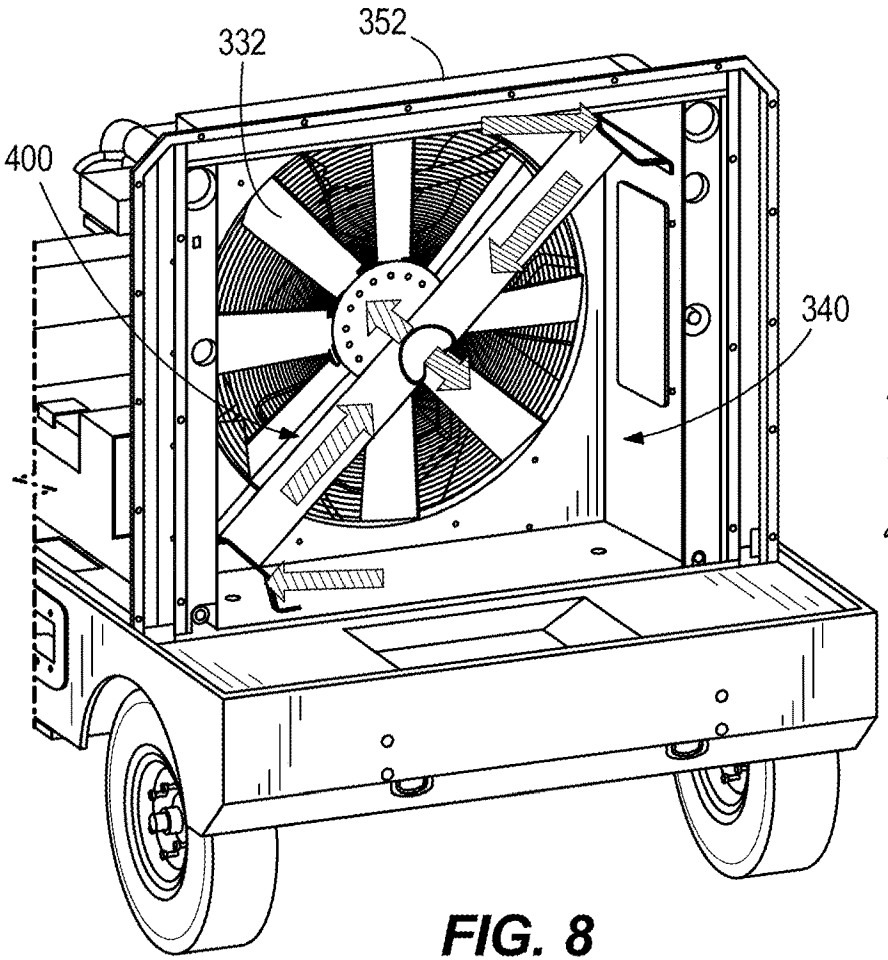
FIG. 8 is a rear perspective view of the power machine of FIG. 5, with the canopy and at least one heat exchanger removed to illustrate a backflow suction reduction assembly positioned in a first region.

The backflow suction reduction assembly 400 is a channel system that is configured to redistribute static pressure (i.e., a stream of air) in the first region 340 (or cold-side) to reduce backflow suction. As illustrated in FIG. 9, in one embodiment, the backflow suction reduction assembly 400 includes a housing 404 that defines an internal channel 408. A first opening 412 is positioned at a first end 416 of the housing 404. A second opening 420 is positioned at a second end 424 of the housing 404. A third opening 428 is defined by the housing 404. The third opening 428 is in fluid communication with the internal channel 408, and as such is in fluid communication with at least one of the first opening 412 or the second opening 420.

Figure 10:
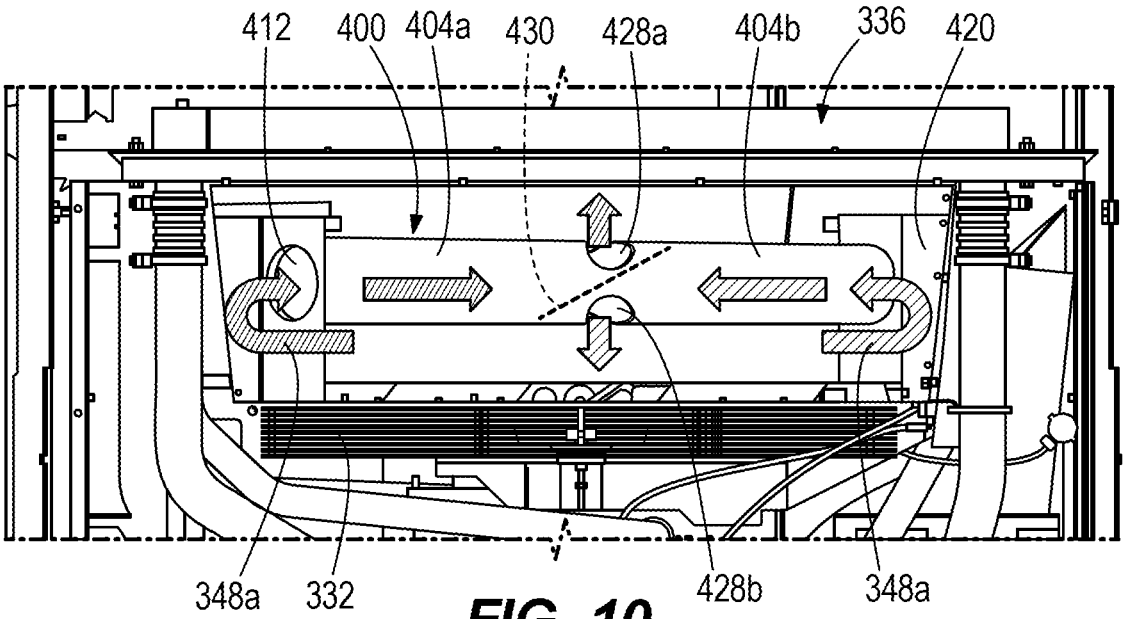
FIG. 10 is a top down view of the power machine of FIG. 8.

As illustrated in FIG. 10, the backflow suction reduction assembly 400 includes a pair of third openings 428*a*, 428*b*. A deflector 430 (or a deflector plate 430 or a plate 430), shown in broken lines, is positioned in the housing 404. The deflector 430 is a solid, structural member that separates the pair of third opening 428*a*, 428*b* to allow for the separate discharge of the cooling air 348*a* through the associated third opening 428*a*, 428*b*. Thus, the third openings 428*a*, 428*b* are separated by the deflector 430. The third openings 428*a*, 428*b* are positioned on opposite sides of the housing 404. In addition, the third openings 428*a*, 428*b* are oriented to be perpendicular to the first and second openings 412, 420. In other embodiments, the third openings 428*a*, 428*b* can be oriented at any geometry relative to each other, and at any preferred angle relative to the first and/or second openings 412, 420.

The first opening 412 is connected to one of the third openings 428*a* by a first internal channel 408*a* (shown in FIG. 9) defined by a first portion of the housing 404*a*. As such, the first opening 412 can be referred to as a first inlet 412, and the third opening 428*a* can be referred to as a first outlet 428*a*. Thus, the first inlet 412 is in fluid communication with the first outlet 428*a* through the first internal channel 408*a* (shown in FIG. 9). The second opening 420 is connected to one of the third openings 428*b* by a second internal channel 408*b* (shown in FIG. 9) defined by a second portion of the housing 404*b*. As such, the second opening 420 can be referred to as a second inlet 420, and the third opening 428*b* can be referred to as a second outlet 428*b*. Thus, the second inlet 420 is in fluid communication with the second outlet 428*b* through the second internal channel 408*b* (shown in FIG. 9). The deflector 430 separates the first and second portions of the housing 404*a*, 404*b* to facilitate separate airflow through each portion of the housing 404.

The first opening 412 (or the first inlet 412) is configured to receive cooling air 348*a*, direct the cooling air 348*a* through the first internal channel 408*a* (shown in FIG. 9), and then discharge the cooling air 348*a* through the third opening 428*a* (or the first outlet 428*a*). As such, the first portion of the housing 404*a* is configured to move cooling air 348*a* from a first area (or a first zone) of the first region 340 and discharge it in a second area (or a second zone) of the first region 340. The second area (or the second zone) is an area where backflow suction occurs.

Similarly, the second opening 420 (or the second inlet 420) is configured to receive cooling air 348*a*, direct the cooling air 348*a* through the second internal channel 408*b* (shown in FIG. 9), and then discharge the cooling air 348*a* through the third opening 428*b* (or the second outlet 428*b*). As such, the second portion of the housing 404*b* is configured to move cooling air 348*a* from a third area (or a third zone) of the first region 340 and discharge it in the second area (or the second zone) of the first region 340. The second area (or the second zone) is again an area where backflow suction occurs. By moving cooling air 348*a* to an area where backflow suction occurs (and thus an area (or zone) where warmer air 348*c* is warmer than the cooling air 348*a* (see FIG. 7)), static pressure is redistributed in the first region 340 (between the fan 332 and the at least one heat exchanger 336). This reduces the impact of backflow suction, as the temperature of the warmer air 348*c* in the first region 340 is reduced. As such, the backflow suction reduction assembly 400 is configured to redistribute cooler air 348*a* into areas (or zones) that container warmer air 348*c*. This results in the temperature of cooling air 348*a* being more uniform (or equalized) through the zones in the first region 340, as the temperature of the air in the area where backflow suction occurs is reduced, improving performance of the cooling assembly 328.

In the embodiment of the backflow suction reduction assembly 400 illustrated in FIG. 10, the third opening 428*a* (or the first outlet 428*a*) is oriented to discharge cooling air 348*a* towards the at least one heat exchanger 336, while the third opening 428*b* (or the second outlet 428*b*) is oriented to discharge cooling air 348*a* towards the fan 332. In other embodiments, the third opening 428*a* (or the first outlet 428*a*) is oriented to discharge cooling air 348*a* towards the fan 332, while the third opening 428*b* (or the second outlet 428*b*) is oriented to discharge cooling air 348*a* towards the at least one heat exchanger 336. In other embodiments the openings 428*a, b* can be oriented to discharge cooling air 348*a* at an angle oblique to the fan 332 and/or the at least one heat exchanger 336.

In the embodiment of the backflow suction reduction assembly 400 illustrated in FIGS. 9-10, the internal channels 408*a*, 408*b* have a cylindrical cross-sectional shape. In other examples of embodiments, the internal channels 408*a*, 408*b* can have any suitable cross-sectional shape (e.g., square, triangular, pentagonal, hexagonal, etc.). In addition, the internal channels 408*a*, 408*b* are illustrated as having the same cross-sectional shape (i.e., cylindrical). In other examples of embodiments, the first internal channel 408*a* can have a cross-sectional shape that is different than the second internal channel 408*b*. More specifically, the first internal channel 408*a* can have a first cross-sectional shape while the second internal channel 408*b* can have a second cross-sectional shape that is different than the first cross-sectional shape. As a nonlimiting example, the first internal channel 408*a* can have a cylindrical cross-sectional shape, while the second internal channel 408*b* can have a square cross-sectional shape. The shape of the internal channel 408*a*, 408*b* (and/or the associated housing 404) can be any suitable or desired shape.

In the embodiment of the backflow suction reduction assembly 400 illustrated in FIGS. 9-10, the internal channels 408*a*, 408*b* have a cross-sectional size (i.e., they have the same circumference, diameter, etc.). As illustrated, the internal channels 408*a*, 408*b* have the same cross-sectional size. In other examples of embodiments, the internal channels 408*a*, 408*b* can have different cross-sectional sizes. For example, the first internal channel 408*a* can have a first cross-sectional size, while the second internal channel 408*b* can have a second cross-sectional size, the first cross-sectional size being different than the second cross-sectional size. Stated another way, the first cross-sectional size can be larger or smaller than the second cross-sectional size (or the second cross-sectional size can be larger or smaller than the first cross-sectional size). The cross-sectional size of the internal channels 408*a*, 408*b* can be any suitable or desired size, and can be based on the desired flow of cooling air 348*a*.

Figure 11:
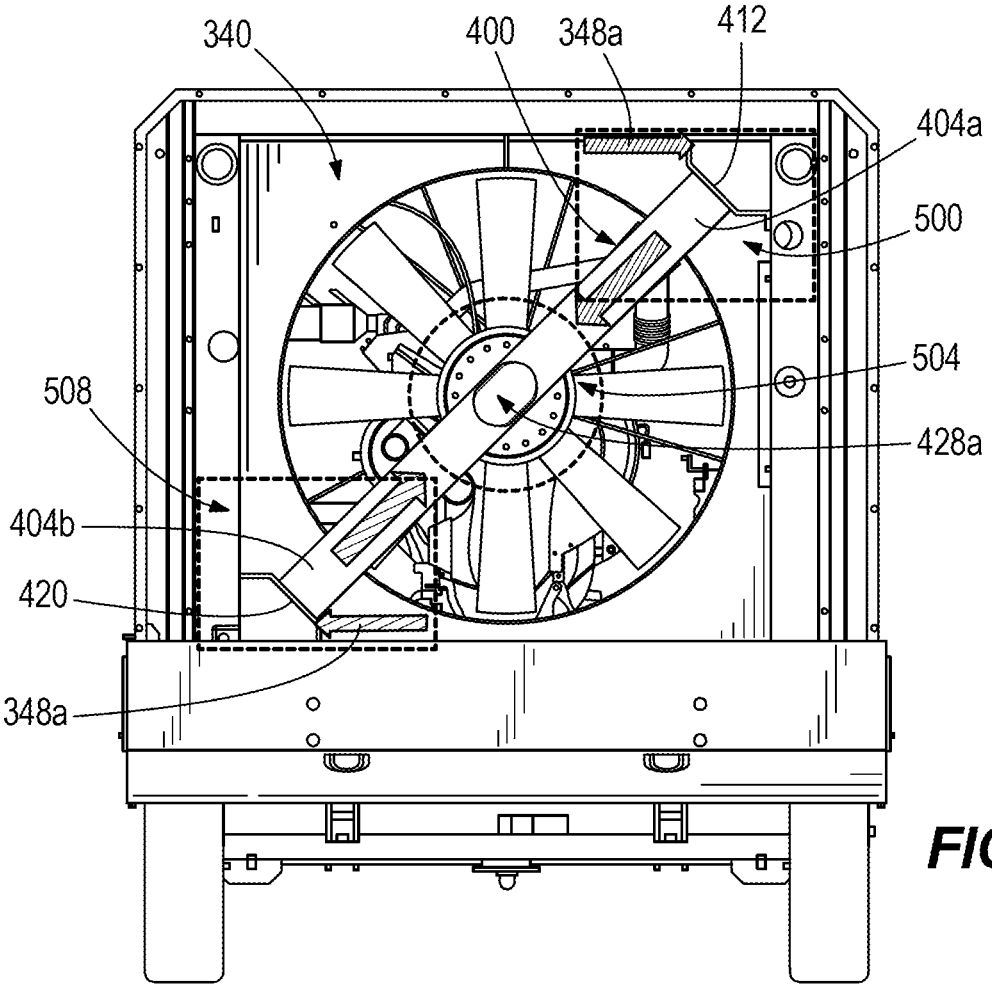
FIG. 11 is a rear view of the power machine of FIG. 8 illustrating different zones of the first region.

With reference now to FIG. 11, the backflow suction reduction assembly 400 is illustrated in relation to a plurality of zones in the first region 340. More specifically, the first region 340 includes a first zone 500 (or a first air region 500 or a first air zone 500), a second zone 504 (or a second air region 504 or a second air zone 504), and a third zone 508 (or a third air region 508 or a third air zone 508). The first zone 500 contains cooling air 348*a* that has a first static pressure. The second zone 504 contains air that has a second static pressure. The third zone 508 contains cooling air 348*a* that has a third static pressure. The first and third static pressures are higher (or greater) than the second static pressure. As such, the static pressure in the first and third zones 500, 508 are higher (or greater) than the static pressure in the second zone 504. This is because the second zone 504 is an area where backflow suction occurs. Accordingly, the backflow suction reduction assembly 400 is configured to push (or transport or direct) cooling air 348*a* between zones of different static pressure. More specifically, the backflow suction reduction assembly 400 is configured to push (or transport or direct) cooling air 348*a* from the first zone 500 to the second zone 504. Cooling air 348*a* enters the first opening 412 (or the first inlet 412) of the first portion of the housing 404*a*. The cooling air 348*a* travels through the first internal channel 408*a* (shown in FIG. 9), where it is discharged through the third opening 428*a* (or the first outlet 428*a*) into the second zone 504. In addition, or alternatively, the backflow suction reduction assembly 400 is configured to push (or transport or direct) cooling air 348*a* from the third zone 508 to the second zone 504. Cooling air 348*a* enters the second opening 420 (or the second inlet 420) of the second portion of the housing 404*b*. The cooling air 348*a* travels through the second internal channel 408*b* (shown in FIG. 9), where it is discharged through the third opening 428*b* (or the second outlet 428*b*) (shown in FIG. 10) into the second zone 504. Stated yet another way, the static pressure at the first and second openings 412, 420 (or first and second inlets 412, 420) is greater than the static pressure at the third openings 428*a, b* (or the first and second outlets 428*a, b*).

In the illustrated embodiment, the first zone 500 is positioned above, and is horizontally (or laterally) offset from the second zone 504. The second zone 504 is positioned above, and is horizontally (or laterally) offset from the third zone 508. Stated another way, the third zone 508 is positioned below, and is horizontally (or laterally) offset from, the second zone 504. In other embodiments, the zones 500, 504, 508 can be positioned in any manner relative to each other, such that the second zone 504 has air where the static pressure is lower than the static pressure of air in the first zone 500 and/or the third zone 508. For example, the zones may be horizontally stacked upon each other. Further, the backflow suction reduction assembly 400 is configured to move air from a zone where the static pressure is high to a zone where the static pressure is low. Accordingly, the backflow suction reduction assembly 400 is configured to move air from the first zone 500 to the second zone 504, and/or from the third zone 508 to the second zone 504. Because the zones may have different shapes and/or orientations relative to each other depending upon the associated cooling assembly 328, the backflow suction reduction assembly 400 can have a different geometry to efficiently move air between the zones 500, 504, 508.

For example, in the embodiment of the backflow suction reduction assembly 400 shown in FIGS. 8-11, the assembly 400 includes first and second openings 412, 420 (or first and second inlets 412, 420) that are spaced from each other, with the third openings 428*a, b* (or the first and second outlets 428*a, b*) positioned between the first and second openings/inlets 412, 420. More specifically, the third openings 428*a, b* (or the first and second outlets 428*a, b*) are centrally located, or equidistant from the first and second openings/inlets 412, 420. The housing 404 also defines a linear housing such that the first portion of the housing 404*a* is generally aligned with the second portion of the housing 404*b*. As such, the first and second openings 412, 420 (or first and second inlets 412, 420) are positioned on opposite (or opposing) ends of the housing 404. Stated another way, the first end 416 of the housing 404 is opposite the second end 424 of the housing 404. The housing 404 is also oriented at an angle (or is sloped) from the first end 416 to the second end 424. Each of the first end 416 and the second end 420 are coupled to the housing 352 that defines the first region 340. This ends 416, 420 thus attaches (or mounts or couples) the assembly 400 in the first region 340. In other embodiments, the assembly 400 includes at least one inlet 412 and at least outlet 428 that are fluidly connected by at least one internal channel 408. The at least one inlet 412 is configured to direct (or transport or push) air from the first zone having a higher static pressure through the at least one internal channel 408 where it is discharged through the at least one outlet 428 into the second zone having a lower static pressure than the first zone. It should be appreciated that in other examples of embodiments, each of the outlets 428*a, b* can be positioned at any suitable location along the housing 404 to direct a discharge of air into a zone (or region) having a static pressure that is lower than the static pressure of the air at the associated inlets 412, 420.

Figure 12:
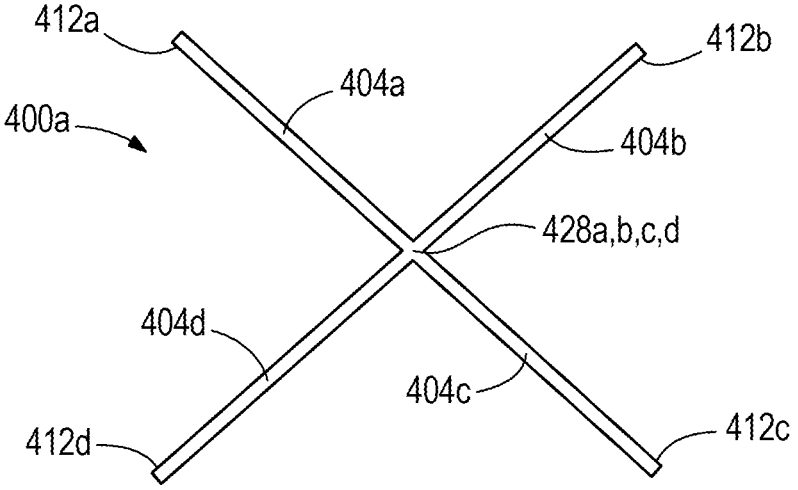
FIG. 12 is another example of an embodiment of the backflow suction reduction assembly for use in the power machine of FIG. 8.

In yet other embodiments, the backflow suction reduction assembly 400 can include alternative geometries. For example, as illustrated in FIG. 12, the assembly 400*a* can have an "X" or "Cross" shaped geometry, when viewed from the same direction as in FIG. 11. The assembly 400*a* can include a plurality of first inlets 412*a, b, c, d* connected to respective first outlets 428*a, b, c, d* by respective internal channels (not shown). The internal channels (not shown) are substantially the same as internal channels 408 shown in FIG. 9. The internal channels are each defined by respective housing portions 404*a, b, c, d*. The first outlets 428*a, b, c, d* can be oriented relative to the assembly 400*a* to discharge air in different directions from each other (e.g., four separate directions), or can be oriented to discharge air in two common directions (two outlets are oriented in one direction, two outlets are oriented in a second different direction).

Figure 13:
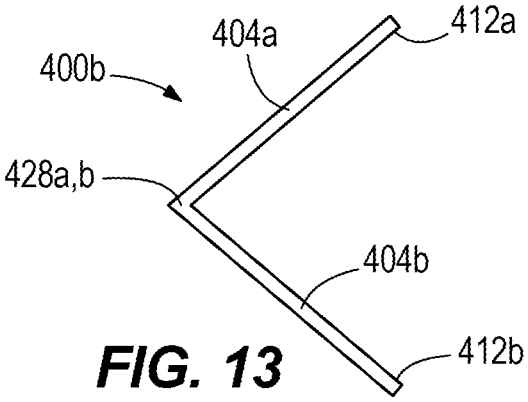
FIG. 13 is another example of an embodiment of the backflow suction reduction assembly for use in the power machine of FIG. 8.

FIG. 13 illustrates another example of a backflow suction reduction assembly 400*b*, where the assembly 400*b* has an angled geometry (such as a "V" on its side, or a less-than sign) when viewed from the same direction as in FIG. 11. The assembly 400*b* can include a first inlet 412*a* connected to a respective first outlet 428*a* by a first housing portion 404*a*. The first housing portion 404*a* defines an internal channel (not shown) connecting the inlet and outlet 412*a*, 428*a*. A second inlet 412*b* is connected to a respective second outlet 428*b* by a second housing portion 404*b*. The second housing portion 404*b* defines an internal channel (not shown) connecting the inlet and outlet 412*b*, 428*b*. The internal channels (not shown) are substantially the same as internal channels 408 shown in FIG. 9. The outlets 428*a, b* are positioned at a vertex where the housing portions 404*a, b* meet. The outlets 428*a, b* can be oriented on opposing sides of the assembly 400*b*, or can be oriented at an angle relative to each other.

Figure 14:
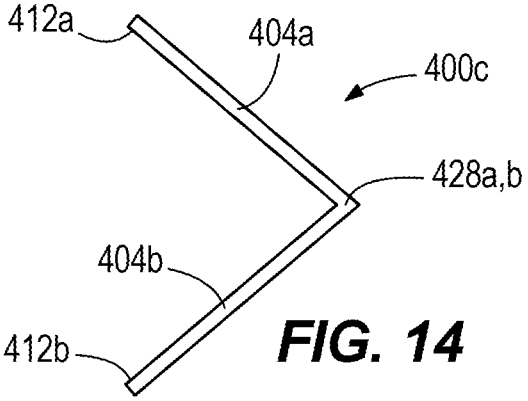
FIG. 14 is another example of an embodiment of the backflow suction reduction assembly for use in the power machine of FIG. 8.

FIG. 14 illustrates another example of a backflow suction reduction assembly 400, where the assembly 400*c* has an angled geometry (such as a "V" on its side, or a greater-than sign) when viewed from the same direction as in FIG. 11. Accordingly, the assembly 400*c* is a mirror image of the assembly 400*b*.

While several alternative embodiments of the assembly 400 are illustrated, it should be appreciated that the assembly 400 can be any geometry suitable for transporting air from a first zone having a higher static pressure (or a lower temperature) to a second zone having a lower static pressure (or a higher temperature).

One or more aspects of the cooling assembly 328 that includes the backflow suction reduction assembly 400 provides certain advantages. For example, by redistributing cooling air from a zone having a higher static pressure to a zone having a lower static pressure, which is indicative of an area adversely affected by backflow suction, overall performance of the cooling assembly 328 is improved by making the temperature of the cooling air more uniform (or equalized) through the zones in the first region 340. In addition, ambient noise can be reduced by decreasing a speed of the fan 332. These and other advantages are realized by the disclosure provided herein.

Although the present invention has been described by referring preferred embodiments, workers skilled in the art will recognize that changes may be made in form and detail without departing from the scope of the discussion.

What is claimed is:

1. A cooling assembly configured to reduce backflow suction in a mobile platform comprising:

a prime mover;

at least one heat exchanger fluidly connected to the prime mover;

a blower upstream of the at least one heat exchanger, the blower configured to generate a current of cooling air to cool the at least one heat exchanger; and a backflow suction reduction member positioned downstream of the blower and upstream of the at least one heat exchanger, the backflow suction reduction member defining a first inlet at a first end, a second inlet at a second end, a first outlet and a second outlet positioned between the first and second ends, a first internal channel fluidly connecting the first inlet to the first outlet, a second internal channel fluidly connecting the second inlet to the second outlet, wherein the first internal channel is fluidly isolated from the second internal channel;

wherein the backflow suction reduction member is configured to receive a first airflow through the first inlet and discharge the first airflow through the first outlet, and receive a second airflow through the second inlet and discharge the second airflow through the second outlet, the first and second airflows being discharged in a region where air is backflowing from the at least one heat exchanger.

2. The cooling assembly of claim 1, wherein the backflow suction reduction member is configured to redistribute static pressure between the blower and the at least one heat exchanger.

3. The cooling assembly of claim 1, wherein the airflow backflowing has a temperature that is greater than the current of cooling air.

4. The cooling assembly of claim 1, wherein the first outlet and the second outlet are oriented on opposite sides of the backflow suction reduction member.

5. The cooling assembly of claim 1, wherein the first outlet and the second outlet are each oriented perpendicular to the first end and the second end.

6. The cooling assembly of claim 1, wherein the second end of the backflow suction reduction member is opposite the first end.

7. The cooling assembly of claim 1, wherein the mobile platform is a mobile air compressor.

8. The cooling assembly of claim 1, wherein the mobile platform is a mobile electrical generator.

9. The cooling assembly of claim 1, wherein the prime mover is a diesel engine.

10. The cooling assembly of claim 1, wherein the at least one heat exchanger includes a plurality of heat exchangers.

11. The cooling assembly of claim 10, wherein the plurality of heat exchangers includes a charging air heat exchanger, an engine coolant heat exchanger, and a compressor oil heat exchanger.

12. The cooling assembly of claim 1, wherein the blower is a fan.

13. The cooling assembly of claim 1, wherein the static pressure at the first opening is less than the static pressure at the at least one third opening, and the static pressure at the second opening is less than the static pressure at the at least one third opening.

14. The cooling assembly of claim 1, further comprising a deflector positioned in the backflow suction reduction member, the deflector configured to fluidly isolate the first internal channel from the second internal channel.

15. A cooling assembly comprising:

at least one heat exchanger;

a first region upstream of the at least one heat exchanger;

a second region downstream of the at least one heat exchanger;

a blower configured to generate a current of cooling air flowing through the first region to cool the at least one heat exchanger, the cooling air configured to increase in temperature in response to interacting with the at least one heat exchanger transitioning to heated air, the heated air configured to discharge through the second region; and a backflow suction reduction assembly positioned in the first region and defining a first inlet at a first end, a second inlet at a second end, a first outlet positioned between the first and second ends, and a second outlet positioned between the first and second ends, the first inlet in fluid communication with the first outlet by a first internal channel, and the second inlet in fluid communication with the second outlet by a second internal channel, the first and second internal channels being fluidly separated to facilitate separate airflow through each channel of the backflow suction reduction assembly, wherein the backflow suction reduction assembly is configured to direct air from a first zone of the first region to a second zone of the first region, the first inlet positioned in the first zone and the first outlet positioned in the second zone, and wherein the backflow suction reduction assembly is configured to direct air from a third zone of the first region to the second zone of the first region, the second inlet positioned in the third zone and the second outlet positioned in the second zone.

16. The cooling assembly of claim 15, wherein a static pressure of air in the first zone is greater than a static pressure of air in the second zone, and a static pressure of air in the third zone is greater than the static pressure of air in the second zone.

17. The cooling assembly of claim 16, wherein the at least one heat exchanger includes one of a charging air heat exchanger, an engine coolant heat exchanger, or a compressor oil heat exchanger.

18. The cooling assembly of claim 15, wherein a temperature of air in the first zone is less than a temperature of air in the second zone, and a temperature of air in the third zone is less than the temperature of air in the second zone.

19. The cooling assembly of claim 15, further comprising a prime mover operably connected to the at least one heat exchanger.

20. The cooling assembly of claim 15, further comprising a deflector configured to separate the first channel from the second channel to facilitate separate airflow.

* * * * *